United States Patent [19]

Florek

[11] Patent Number: 4,928,912

[45] Date of Patent: May 29, 1990

[54] PEGBOARD HANGER ANCHOR

[75] Inventor: Bronislaw B. Florek, Chicago, Ill.

[73] Assignee: ABC Consulting Services, Inc., Oak Brook Terrace, Ill.

[21] Appl. No.: 397,905

[22] Filed: Aug. 24, 1989

[51] Int. Cl.[5] ..... E04G 3/00

[52] U.S. Cl. ..... 248/221.2; 248/221.4

[58] Field of Search ..... 248/220.3, 220.4, 221.1, 248/221.2, 221.4

[56] References Cited

U.S. PATENT DOCUMENTS

| | | | |
|---|---|---|---|
| 1,767,745 | 6/1930 | Day . | |
| 2,728,259 | 12/1955 | Poupitch | 248/220.3 |
| 2,859,008 | 11/1958 | Zimmer . | |
| 2,961,724 | 11/1960 | Alling . | |
| 2,981,513 | 4/1961 | Brown | 248/221.2 X |
| 3,037,732 | 6/1962 | Roman | 248/222.1 X |
| 3,037,733 | 6/1962 | Roman . | |
| 3,069,122 | 12/1962 | Babajoff . | |
| 3,241,799 | 3/1966 | Terlinde . | |
| 3,477,677 | 11/1969 | Hindley . | |
| 3,640,497 | 2/1972 | Waki . | |
| 3,650,502 | 3/1972 | Langhi | 248/220.4 |
| 4,094,483 | 6/1978 | Busch . | |
| 4,441,680 | 4/1984 | Rivkin et al. . | |
| 4,645,154 | 2/1987 | Bly | 248/220.4 |
| 4,714,221 | 12/1987 | Cawrey | 248/220.3 |
| 4,799,637 | 1/1989 | Fahringer | 248/221.2 |

FOREIGN PATENT DOCUMENTS

| | | | |
|---|---|---|---|
| 1049478 | 2/1979 | Canada | 248/220.3 |

*Primary Examiner*—David L. Talbott

*Attorney, Agent, or Firm*—Wallenstein, Wagner & Hattis, Ltd.

[57] ABSTRACT

An anchor for stabilizing and securing a hanger in a pegboard is disclosed. The anchor is formed to provide an arcuate portion to accommodate the hanger and has legs and feet which are inserted through a perforation in the pegboard. Terminal ends of the feed abut against a rear face of the pegboard to prevent accidently dislodging the hanger from the pegboard.

10 Claims, 1 Drawing Sheet

PEGBOARD HANGER ANCHOR

DESCRIPTION

1. Technical Field of the Invention

The present invention relates to an apparatus for stabilizing a pegboard hanger upon a pegboard.

2. Background of the Invention

Pegboards, usually made of hardboard or the like, are commonly used to support various articles such as tools. Pegboards, having both front and rear surfaces, are perforated in vertical and horizontal rows at regular intervals in a grid-like fashion to allow articles to be supported at various locations on the pegboards. Pegboards vary in thickness, but are generally of a thickness of approximately ¼".

Articles are supported on the pegboard using hangers, as is well-known. Such a hanger is typically in the form of a hook formed of a single length of wire having a diameter slightly less than that of the perforations in the pegboard. The hangers have a vertically extending body or shank, with an article support member extending forwardly from the lower end of the body or shank, formed by bending the wire at the lower end. An intermediate portion of the wire is left straight to form the body or shank and is typically of a length slightly greater than the vertical spacing of the perforations.

The hangers are secured to the pegboard by inserting one end into a perforation in the pegboard, the inserted end of the hanger having an offset portion which acts to secure the hanger to the pegboard.

In the use of this type of hanger, it has been found that when an article is placed on or removed from the hanger, resulting outward and lateral forces on the hanger cause it to dislodge from the pegboard by pulling the inserted offset end from the hole in the pegboard. This undesired disengagement from the pegboard is objectionable to the extent that anchors of various types for preventing accidental disengagement of the hanger from the pegboard have been attempted. See, for example, U.S. Pat. Nos. 3,037,732, 3,241,799, 3,477,677, and 4,441,680. However, the anchors disclosed in these patents are structurally complicated, and are therefore relatively expensive to manufacture. The present invention is provided to solve these and other problems.

SUMMARY OF THE INVENTION

It is an object of the invention to provide a simple and inexpensive anchor for releasably stabilizing a pegboard hanger on a pegboard. The invention provides a reasonable anchor for stabilizing a hanger in a pegboard against lateral and forward forces that is simple to use, easily and inexpensively manufactured, easily put in place or removed and adaptable for use with all conventional hangers and pegboards.

According to the invention, the anchor comprises a thin, generally M-shaped strip of deformable, resilient material, such as aluminum or steel, of a length of approximately 2" and a width of approximately ⅛". The strip is formed to provide a generally arcuate portion near its center to accommodate a hanger. The remaining portions of the strip form two legs which extend from opposing ends of the arcuate portion. The legs are bent to project rearwardly from the arcuate portion, generally parallel to each other. The legs are bent outwardly at a point about ¼" from their ends to form feet.

The feet each have a terminal end defined by an end of the strip.

The anchor is adapted to stabilize a hanger having an offset end, a hooked end, and a vertical shank portion. One end of the hanger is inserted through the arcuate portion until the arcuate portion is positioned at a point along the vertical shank of the hanger. The offset end of the hanger is then inserted through a perforation in the pegboard, and the legs and feet of the anchor are inserted through another perforation, typically one directly beneath. The insertion of the legs and feet compresses the legs and feet as they pass through the perforation. The anchor is pushed through the perforation until the feet clear the rear edge of the hole at the rear surface of the pegboard, at which point spring action of the feet relative to the legs caused by the resilience of the strip spreads the feet apart, causing the terminal ends of the feet to abut against the rear surface of the pegboard. The contact between the terminal ends of the feet and the rear of the pegboard resists the lateral and forward forces on the hanger caused by placing articles on and removing them from the hanger to prevent accidental disengagement of the hanger from the pegboard.

To remove the hanger and anchor from the pegboard, the hanger is grasped and pulled outwardly from the pegboard with sufficient force to bend and straighten the feet, thereby allowing the anchor to be pulled back through the perforation through which it was originally inserted. To re-use the anchor, the feet are simply rebent to their original position.

Other advantages and aspects of the invention will become apparent upon making reference to the specification, claims and drawings to follow.

DETAILED DESCRIPTION

Figure 1:
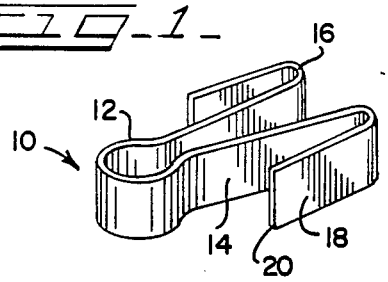
FIG. 1 is a perspective view of an anchor according to the present invention.

While this invention is susceptible of embodiment in many different forms, there is shown in the drawings, and will herein be described in detail, a preferred embodiment of the invention with the understanding that the present disclosure is to be considered as an exemplification of the principles of the invention, and is not intended to limit the broad aspect of the invention to the embodiment illustrated.

A pegboard hanger anchor 10 comprising a generally arcuate portion 12 and a pair of legs 14 projecting rearwardly from opposing ends of the arcuate portion 12 are disclosed in FIG. 1. The legs 14 are bent forwardly at a point 16 to form feet 18. Each of the feet 18 is preferably of a length of about ¼" and has a terminal end 20. The anchor 10 is preferably made of a deformable, resilient material, such as aluminum or steel.

Figure 2:
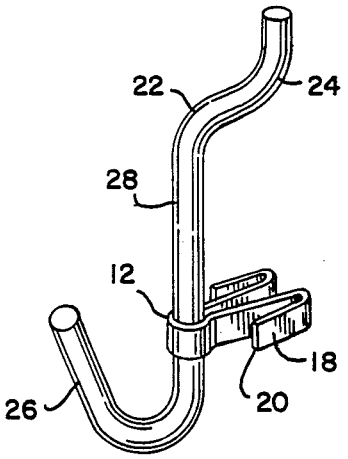
FIG. 2 is a perspective view of the anchor attached to the hanger.

FIG. 2 illustrates the anchor 10 attached to a hanger 22. The hanger 22 has an offset end 24, a hook portion 26 and a vertical shank portion 28. The arcuate portion 12 is of a diameter to receive the vertical shank portion 28.

Figure 3:
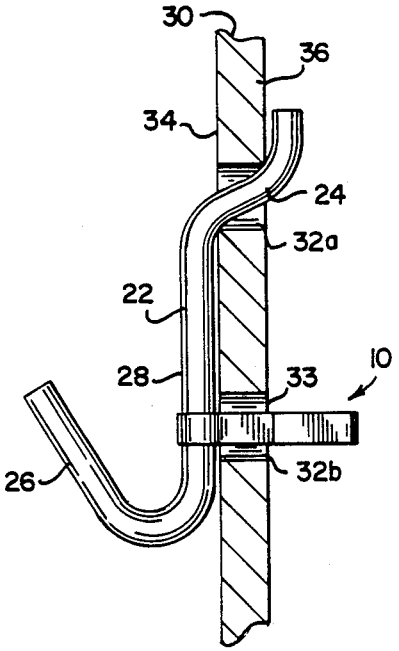
FIG. 3 is a side elevational view of the anchor attached to the hanger and inserted into a pegboard.

FIG. 3 discloses a pegboard 30, having a plurality of perforations 32 including a first perforation **32*a* and a second perforation 32b, where perforation 32a is located directly above perforation 32b at a distance slightly less than the length of the vertical shank 28 of the hanger 22. The pegboard 30 has front and rear surfaces 34 and 36, respectively, to stabilize the hanger 22 on the pegboard 30, the offset end 24 of the hanger 22 is inserted into the first perforation 32a of the pegboard 30. The hanger 22 is then rotated downward to insert the feet 18 and the legs 14 of the anchor 10 through the second perforation 32b immediately below the first perforation 32a into which the offset end 24 of the hanger 22 was inserted. The anchor 10 and hanger 22 are pushed in a direction generally perpendicular to, and toward the pegboard 30, so that the feet 18 of the anchor 10 pass completely through the second perforation 32b. After the feet 18 have cleared a rear edge 33 of the second perforation 32b, the insertion is stopped. Spring action caused by the resilience of the feet 18 compressed against legs 14 causes the each of the feet 18 to spring outward from their respective legs 14, and the terminal end 20 of the feet 18 to abut against the rear surface 36 of the pegboard 30**.

Figure 4:
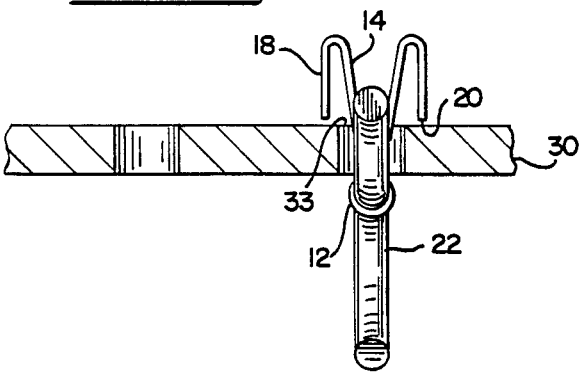
FIG. 4 is a top plan view of the anchor in its operational position after insertion into the pegboard.

FIGS. 3 and 4 disclose the present invention after the hanger 22 has been mounted on the pegboard 30. The terminal ends 20 of feet 18 of the anchor 10 abut against the rear surface 36 of the pegboard 30 to stabilize and secure the hanger 22 to the pegboard 30, and thus prevent accidentally dislodging the hanger 22 from the pegboard 30.

To remove the hanger 22 and anchor 10 from the pegboard 30, the hanger 22 is pulled forcibly in an outward direction from the pegboard 30, thereby straightening the feet 18 to permit easy removal of the hanger 22 through the perforation 32b of the pegboard 30 through which it was first inserted. The anchor 10 may be used a number of times by simply re-bending the feet 18 back to their original position after removal of the hanger 10 from the perforation 32b of the pegboard 30.

While a specific embodiment has been illustrated and described, numerous modifications come to mind without departing from the spirit of the invention, and the scope of protection is only limited by the scope of the accompanying claims.

I claim:

1. An anchor to stabilize a hanger in a pegboard, the pegboard having a plurality of perforations and front and rear surfaces, the hanger having a vertically elongated shank with a forwardly extending hook to support articles thereon, said anchor comprising:

means for attaching said anchor to said elongated shank;

a pair of legs extending rearwardly from opposing ends of said attaching means, and adapted for insertion through one of the perforations; and, a pair of feet having terminal ends extending forwardly from each of said legs and directed substantially toward said attaching means, said feet further adapted to abut the rear surface of the pegboard at said terminal ends.

2. The anchor of claim 1 wherein said attaching means comprises a generally arcuate portion adapted for extending around the elongated shank.

3. The anchor of claim 1 wherein said legs are substantially parallel to each other.

4. The anchor of claim 3 wherein said feet are substantially parallel with said legs.

5. The anchor of claim 1 wherein said feet are substantially parallel with said legs.

6. The anchor of claim 1 wherein each of said feet and its respective leg define an acute angle.

7. The anchor of claim 1 wherein said anchor is formed of a deformable, resilient material.

8. The anchor of claim 7 wherein said material is aluminum.

9. The anchor of claim 7 wherein said material is steel.

10. An anchor to stabilize a hanger in a pegboard, the pegboard having a plurality of perforations and front and rear surfaces, the hanger having a vertically elongated shank with a forwardly extending hook to support articles thereon, said anchor being formed of a resilient, deformable material comprising:

a generally arcuate portion adapted for extending around the elongated shank;

a pair of legs extending rearwardly from opposing ends of said arcuate portion, and adapted for insertion through one of the perforations, said legs being substantially parallel to each other; and, a pair of feet having terminal ends extending outwardly from each of said legs, said feet being substantially parallel with said legs and being directed substantially toward said arcuate portion to define an acute angle with its respective leg, said feet further adapted to abut the rear surface of the pegboard at said terminal ends.

* * * * *

UNITED STATES PATENT AND TRADEMARK OFFICE

CERTIFICATE OF CORRECTION

PATENT NO. : 4,928,912

DATED : May 29, 1990

INVENTOR(S) : Bronislaw B. Florek

It is certified that error appears in the above-identified patent and that said Letters Patent is hereby corrected as shown below:

On the title page:
Assignee, delete "ABC" and insert --ABR--.

Abstract, line 5, delete "feed" and insert --feet--.

Column 3, line 20, after "causes" delete "the".

Signed and Sealed this

Twenty-ninth Day of October, 1991

*Attest:*

HARRY F. MANBECK, JR.

*Attesting Officer*

*Commissioner of Patents and Trademarks*